US005469649A

United States Patent [19]

Rowlands et al.

[11] Patent Number: 5,469,649

[45] Date of Patent: Nov. 28, 1995

[54] FIREARM TOP LEVER ADJUSTING SYSTEM

[75] Inventors: Kenneth C. Rowlands, Utica; Thomas G. Bauman, Ilion, both of N.Y.

[73] Assignee: Remington Arms Company, Inc., Wilmington, Del.

[21] Appl. No.: 175,852

[22] Filed: Dec. 30, 1993

[51] Int. Cl.[6] ..... F41A 3/58

[52] U.S. Cl. ..... 42/43; 42/45; 42/46; 42/47; 42/41

[58] Field of Search ..... 42/46, 47, 48, 42/43, 44, 45, 40, 41, 42.01, 42.02, 42.03

[56] References Cited

U.S. PATENT DOCUMENTS

| | | | |
|---|---|---|---|
| 381,088 | 4/1888 | Smith | 42/44 |
| 572,520 | 12/1896 | Blanchard | 42/40 |
| 798,469 | 8/1905 | Watson | 42/48 |
| 810,046 | 1/1906 | Fox | 42/44 |
| 1,900,184 | 3/1933 | Loomis . | |

FOREIGN PATENT DOCUMENTS

| | | | |
|---|---|---|---|
| 607363 | 7/1926 | France | 42/44 |
| 1214615 | 4/1960 | France | 42/44 |
| 1313501 | 11/1962 | France | 42/40 |

*Primary Examiner*—Stephen M. Johnson
*Attorney, Agent, or Firm*—Donald W. Huntley

[57] ABSTRACT

A break open firearm having a top lever adjusting system that allows the radial position of the centerline of the top lever to be easily positioned just to the right of the centerline of the frame top tang when the action is closed.

8 Claims, 19 Drawing Sheets

FIREARM TOP LEVER ADJUSTING SYSTEM

BACKGROUND OF THE INVENTION

This invention relates to a break open firearm that has a top lever adjusting system and preferably an automatic ejection system, an automatic safety system and a fore-end tension adjusting system.

Break open firearms, and particularly over and under shotguns in which the barrels are alligned vertically in the firing position, have long been known. However, several features have been subject to continuing development.

The ejection system, for removing spent shells from the firearm, desireably should be easily converted between automatic and manual, to accomodate shooters who save their fired shells for reloading.

Further, adjusting systems are needed to allow the radial positioning of the centerline of the top lever just to the right of the centerline of the frame top tang when the action is closed. Specifically, a top lever adjusting system would be desireable that allows the radial position of the centerline of the top lever to be easily positioned just to the right of the centerline of the frame top tang when the action is closed. This would ensure that as wear occurs to the firearm's locking system, the top lever centerline would gradually move to be inline with the centerline of the top tang. A gun which has its top lever centerline to the left of the top tang centerline is generally considered to be "worn-out," although this might not necessarily be the case. A further requirement is that the top lever always be in a position to latch itself open at approximately the same time as the barrel assembly is released to be pivoted open.

Still another desireable feature of such firearms would be an automatic safety system that can be easily converted to a manual safety, combined with a safety/barrel selector mechanism that could also be locked in the fire position to always fire a preselected barrel first. A large number of modern over and under shotguns incorporate a safety switch that is automatically returned to the "safe" position each time the top lever is operated to break the gun open for reloading or unloading. This requires that the safety switch be pushed to the fire position before the gun can again be fired. Many competitive target shooters do not like this automatic safety system and will have it converted to a manual safety system, such that as soon as the gun is reloaded it can be fired without having to operate the safety switch.

All shotguns that incorporate automatic safeties can have them modified to manual safeties. This procedure is somewhat involved, requiring that parts be permanently removed from the safety mechanism by a competent gunsmith. Currently available shotguns cannot have the safety mechanism modified easily by the owner.

A further need for break open shotguns is a fore-end assembly tension adjusting system that allows barrel interchangeability with no change in fore-end assembly tension. It is considered desirable on modem shotguns that the fore-end iron radius should be a tight fit against the mating radius of the frame, such that it produces a slight drag to prevent the barrel assembly from flopping down when the top lever is rotated to open the gun. The majority of shotgun manufacturers accomplish this by hand fitting the rear surface of the barrel lug such that there is no clearance between it and its mating surface on the fore-end iron, as well as between the mating radii of the frame and fore-end iron and between the frame trunnions (pivot pins) and their mating half radius cuts in the barrel mono-block. This is a time consuming operation requiring a high degree of skill.

Over time these surfaces will wear, especially the trunnion and mono-block surfaces which are subjected to the full gun recoil forces. This eventually leads to loose fitting parts. These potential problems have previously been handled by providing a screw type adjustment device in the fore-end iron. This solution has worked well except in those cases where a gun has been equipped with more than one barrel assembly, which is common in the over and under shotgun market. This has required that the fore-end iron be disassembled from the fore-end so that adjustments can be made to suit each individual barrel assembly.

SUMMARY OF THE INVENTION

The instant invention provides top lever adjusting system that allows the radial position of the centerline of the top lever to be easily positioned just to the right of the centerline of the frame top tang when the action is closed. There is further provided a preferred automatic ejection system that utilizes the hammer cocking rods to cam the ejector sears into position to latch the ejectors. The firarm of the present invention preferably further comprises an automatic safety system that can be easily converted to a manual safety, combined with a safety/barrel selector mechanism that can also be locked in the fire position to always fire a preselected barrel firsts. A further preferred feature of the present invention is a fore-end assembly tension adjusting system that allows barrel interchangeability with no change in fore-end assembly tension, by providing an easily accessible tension adjusting screw that is mounted in the barrel lug.

Specifically, the present invention provides, in a break open firearm having a frame attached to a stock, a barrel housing carrying at least one barrel and rotatable about a pivot on the frame, at least one hammer pivotally mounted on the stock frame for movement from a cocked position to a position against the frame acted on by a hammer strut, a hammer spring urging the hammer strut forwardly, a firing pin alligned with each hammer trigger means operatively connected to actuate the hammer, a cocking rod mounted for reciprocation on the frame for acting on the hammer strut, and cam means for moving the cocking rod rearward when the barrel housing is rotated about the frame, a fore-end housing, and means for ejecting cartridges from the firearm, the improvement comprising a top lever pivotally mounted on the frame for opening the firearm, the top lever having an off-center cam projection which activates a locking bolt slideably positioned in the frame to engage a barrel assembly locking lug to move a locking bolt between locked and unlocked positions, the cam projection being positioned in an axial opening, and forward and rearward adjusting screws positioned to impinge on at least a portion of the base of the cam projection to adjust the position of the cam projection within the axial opening and the position of the top lever.

DETAILED DESCRIPTION OF THE INVENTION

Figure 1:
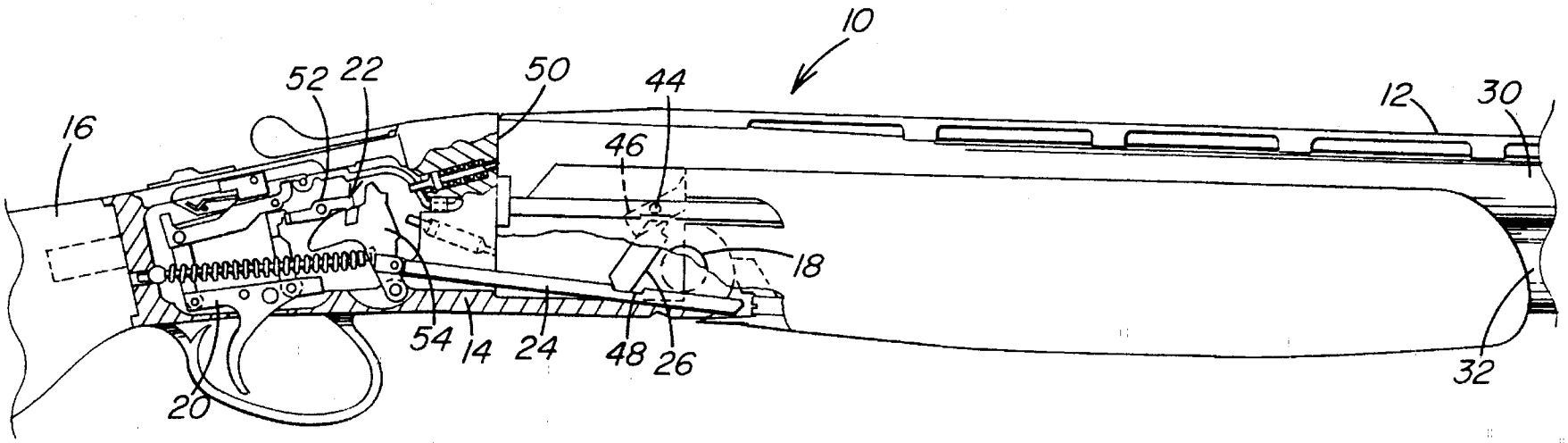
FIG. 1 is a side view, partially in section, of an entire gun mechanism of the present invention, in the ready to fire condition.

The present invention is illustrated in detail in the several drawings, in which FIG. 1 is a partly cut-away illustration of an over and under shotgun assembly 10 with a barrel assembly 12, comprising joined barrels 30 and 32, a receiver frame 14 and stock 16. The barrel assembly 12 is pivotally received at 18 in recesses (not shown) in the frame 14. The frame 14 houses a trigger assembly 20 and firing assembly 22 similar to that shown in U.S. Pat. No. 3,808,724, and for the purposes of this disclosure is hereby incorporated by reference.

FIGS. 2 to 5 illustrate the hammer cocking rod 24, having cam 48 formed therein, camming the ejector sears 26 into a position to latch the ejectors 28. In these illustrations, only one side of thes automatic ejector system is illustrated and it will be appreciated that in a double-barreled shotgun each side of the ejector system is the same for each of barrels 30 and 32.

The ejector sear 26 is slidably held in a dove tail slot 34 in the barrel assembly by a detent spring 36. The ejector 28, having a plunger 38 in slot 40 of the barrel assembly, is biased rearwardly by spring 42. A pin 44 on ejector 28 rides in cam 46 in the frame to position the ejector 28 forwardly against the bias of spring 42 when the barrel assembly is in the closed position.

Figure 2:
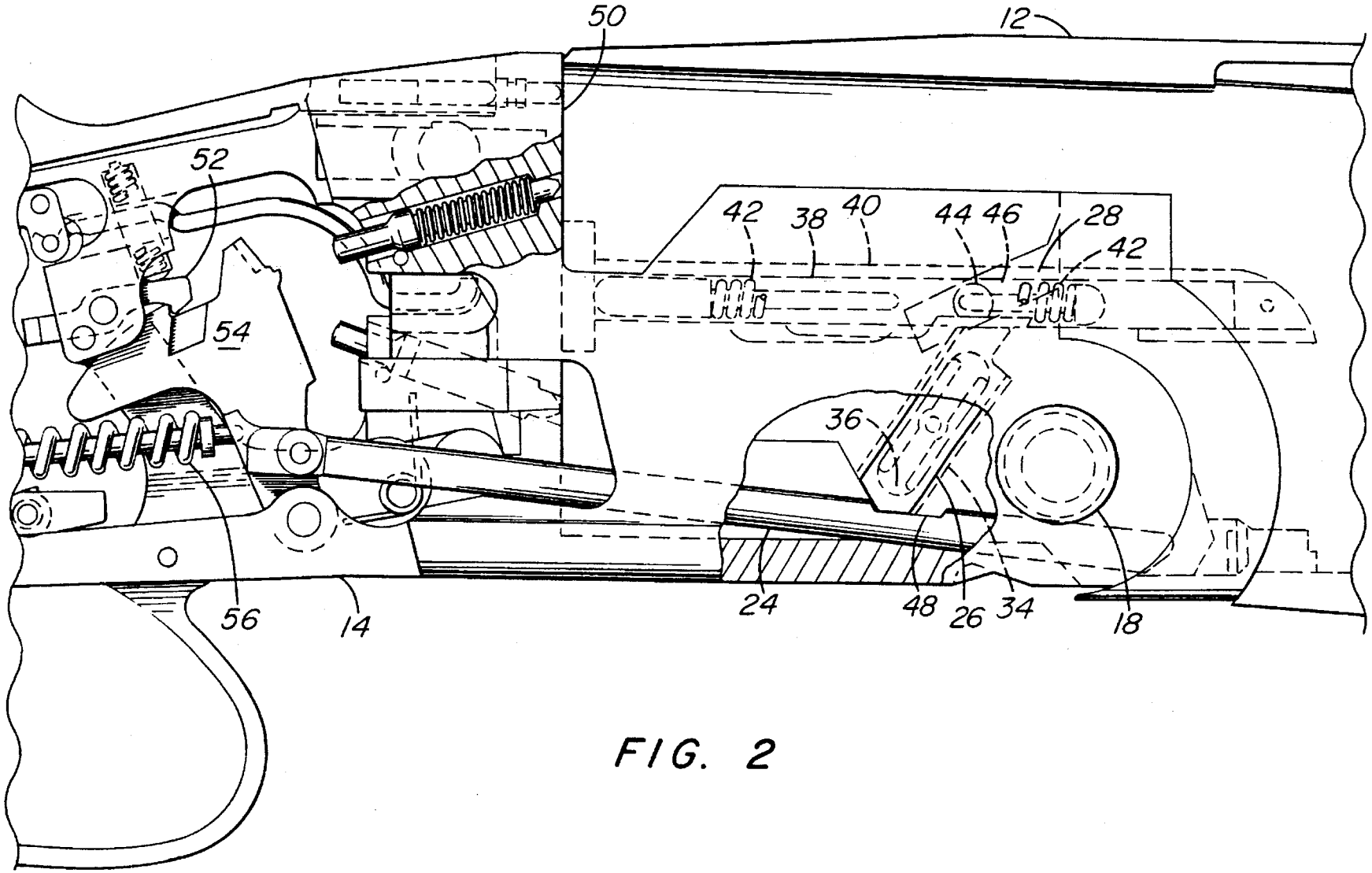
FIG. 2 is an enlarged side view, partially in section, showing the hammer in the cocked position and the cocking rod in the rearward position.

In FIG. 2, the hammer cocking rod 24 is in the rearward position with the ejector sear 26 resting in the cam 48 cut into the rod 24. The ejector 28 is held fully forward by the breach face 50 of the frame. As the trigger assembly is operated and the sear 52 releases the hammer 54, which is forced forward by spring assembly 56, the rod 24 moves forward as shown in FIG. 3, and the ejector sear 26 is cammed upward to a position to latch the ejector 28, groove 29 formed therein, when it moves rearward.

Figure 3:
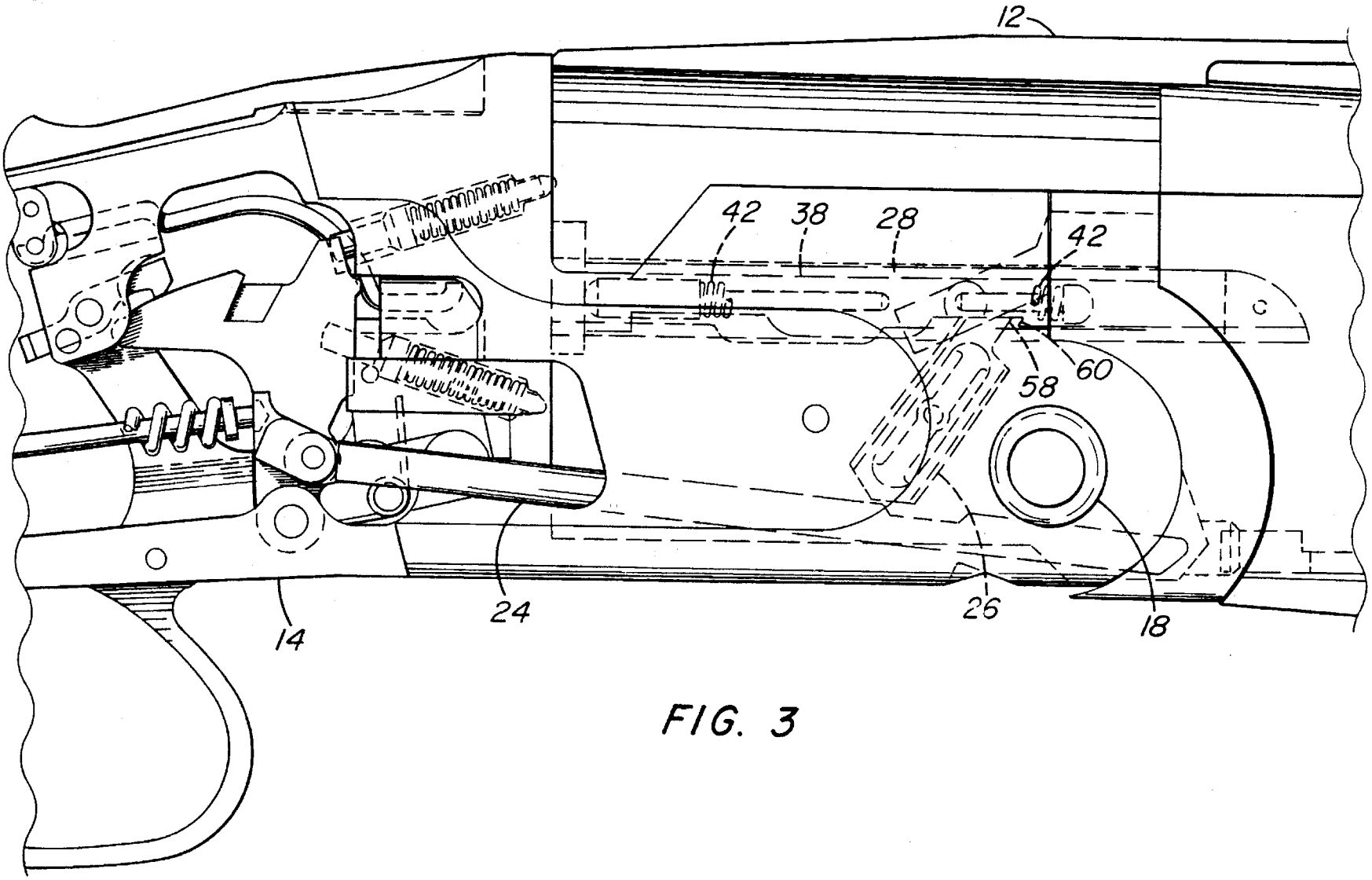
FIG. 3 is the same as FIG. 2, showing the hammer fired, with the cocking rod moved forward, camming the ejector sear upward to a position to latch the shell ejector.
Figure 4:
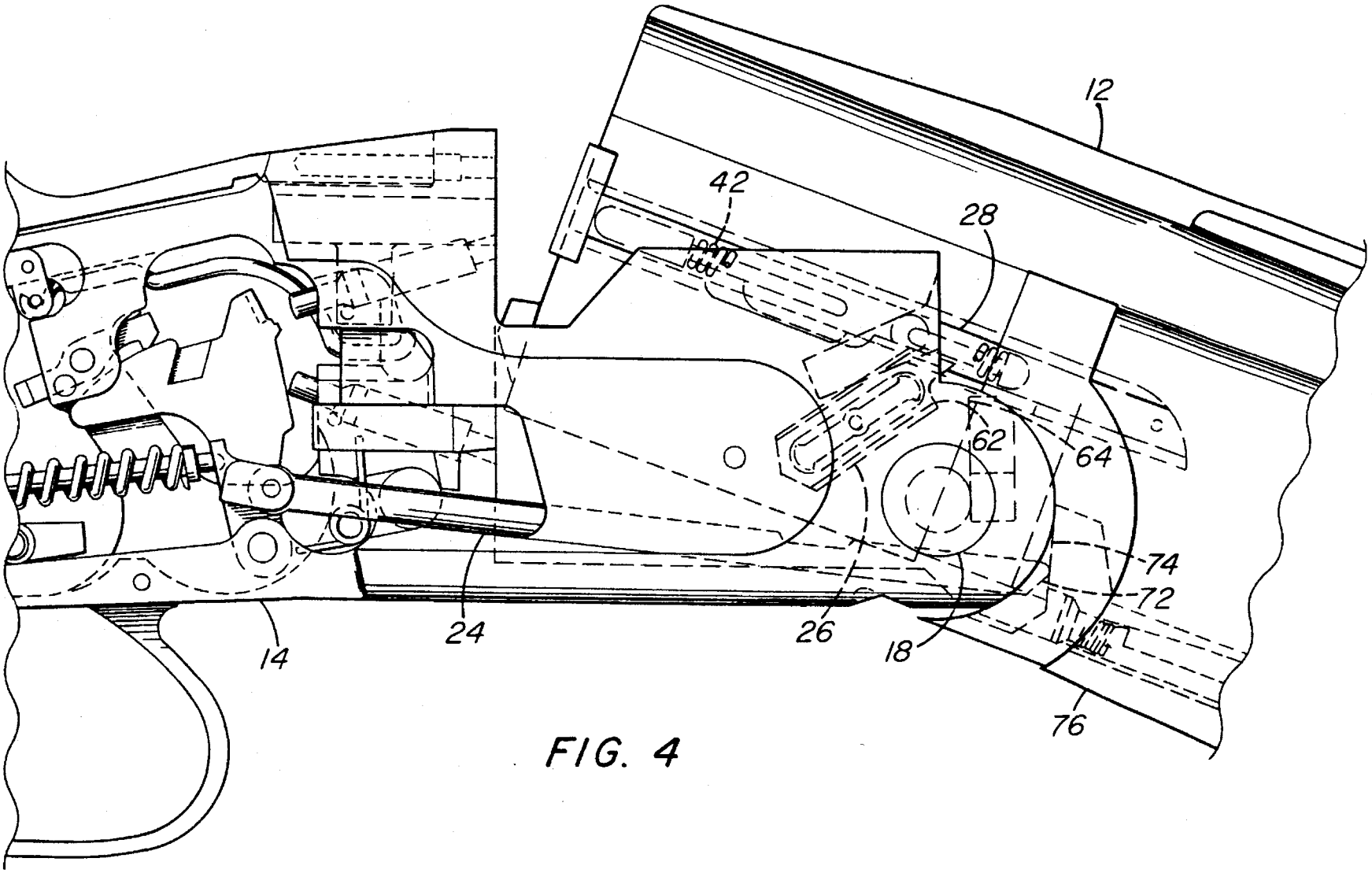
FIG. 4 is a view similar to FIGS. 2 and 3, illustrating the barrel assembly starting to pivot open with the ejector cam cut in the receiver frame permitting the ejector sear to latch the ejector.

After the firing sequence, as shown in FIG. 3, and the barrel assembly is pivoted open slightly (approximately 20 degrees), as shown in FIG. 4, the ejector pin 44 on the ejector riding in the frame cam 46 allows the ejector to move rearward until the nose portion 58 on ejector sear 26 engages the shoulder 60 on ejector 28 to permit the ejector sear to latch the ejector .against rearward movement and against the bias of spring 42.

Figure 5:
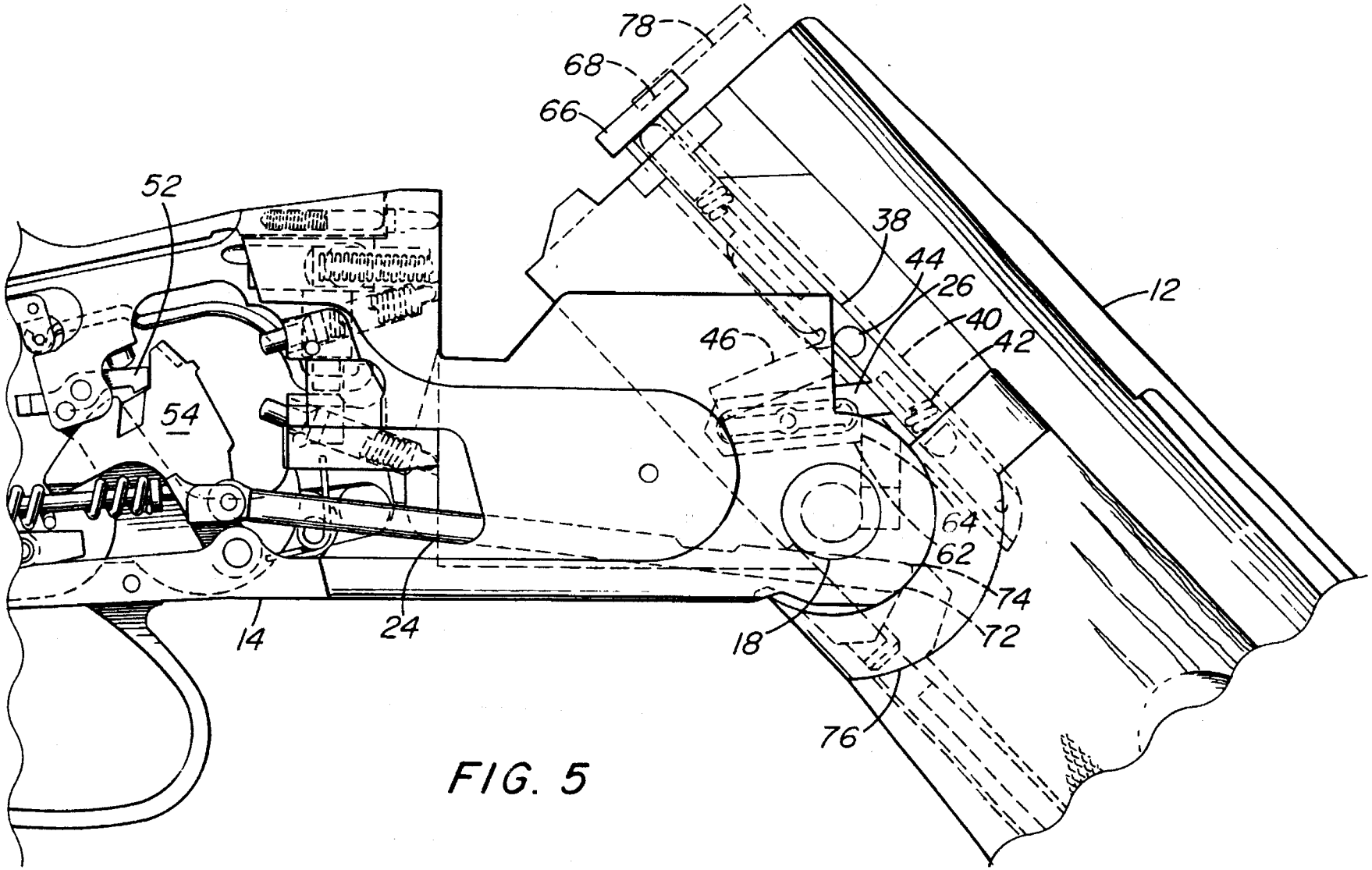
FIG. 5 is a view similar to FIGS. 2 to 4, illustrating the barrel assembly pivoted fully open with the ejector sear cammed rearward by the frame projection that stops barrel rotation, thus releasing the ejector to eject the fired shell from the chamber.

As the barrel assembly is pivoted fully open (approximately 47 degrees), as shown in FIG. 5, the shoulder 62 on the ejector sear 26 contacts the frame projection 64 camming the ejector sear rearward, releasing the ejector so that the ejector spring 42 will mow: the ejector 28 rearward so the ejector head 66, having a recess 68 riding trader the shell head lip 70, will eject the fired shell. As the end 72 of the hammer cocking rod 24 contacts the cocking cam cut 74 in the fore-end iron 76, the cocking rod 24 is thus cammed fully rearward, overcocking the hammer. When the barrel assembly is subsequently rotated to close the gun, the hammer 54 will move forward until latched by sear 52, as shown in FIG. 2.

To convert the gun to manual ejection, the ejector sears 26 and detent springs 36 can be pushed out of their dove-tail slots in the barrel assembly.

FIGS. 6 to 14 illustrate the top lever adjusting system of the present invention.

Figure 7:
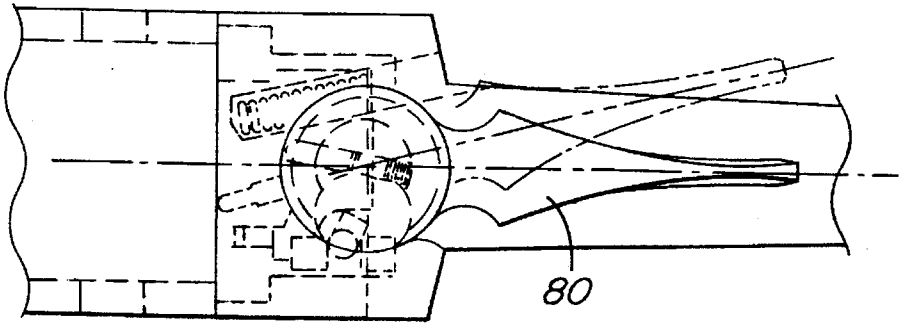
FIG. 7 is a partial top view of the top lever adjusting system in the same position as FIG. 6.
Figure 6:
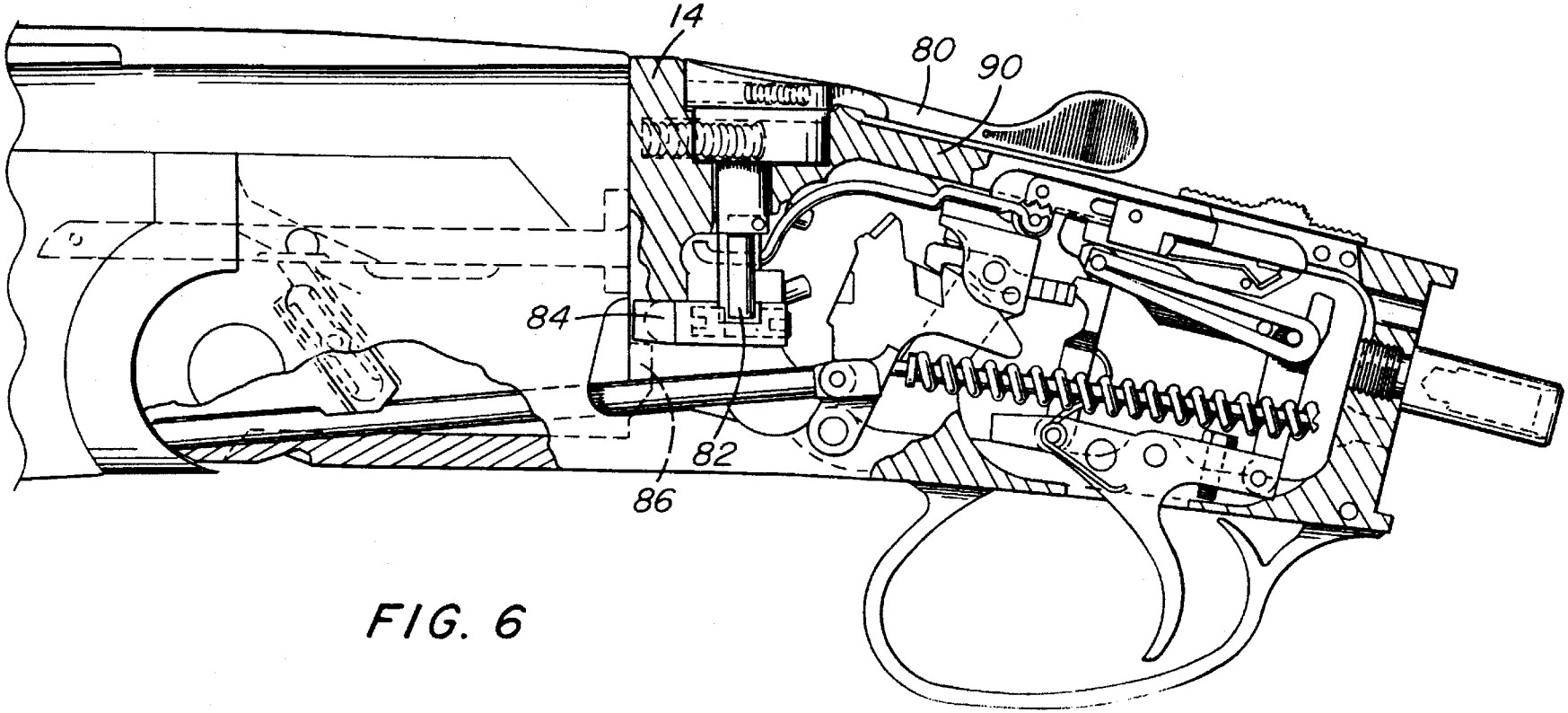
FIG. 6 is a left hand side view of the top lever adjusting system in the locked read-to-fire position.
Figure 9:
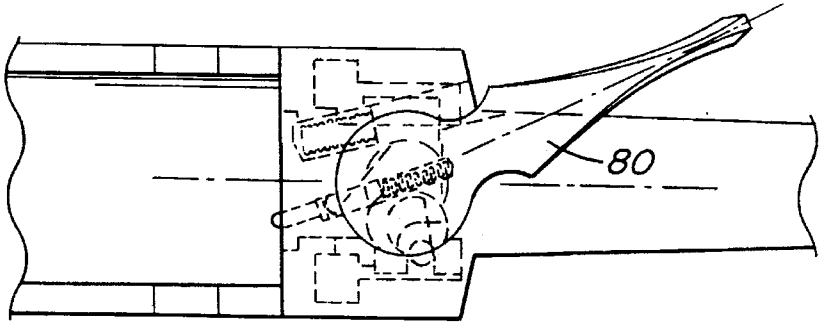
FIG. 9 is a partial top view of the top lever adjusting system in the same position as FIG. 8.
Figure 8:
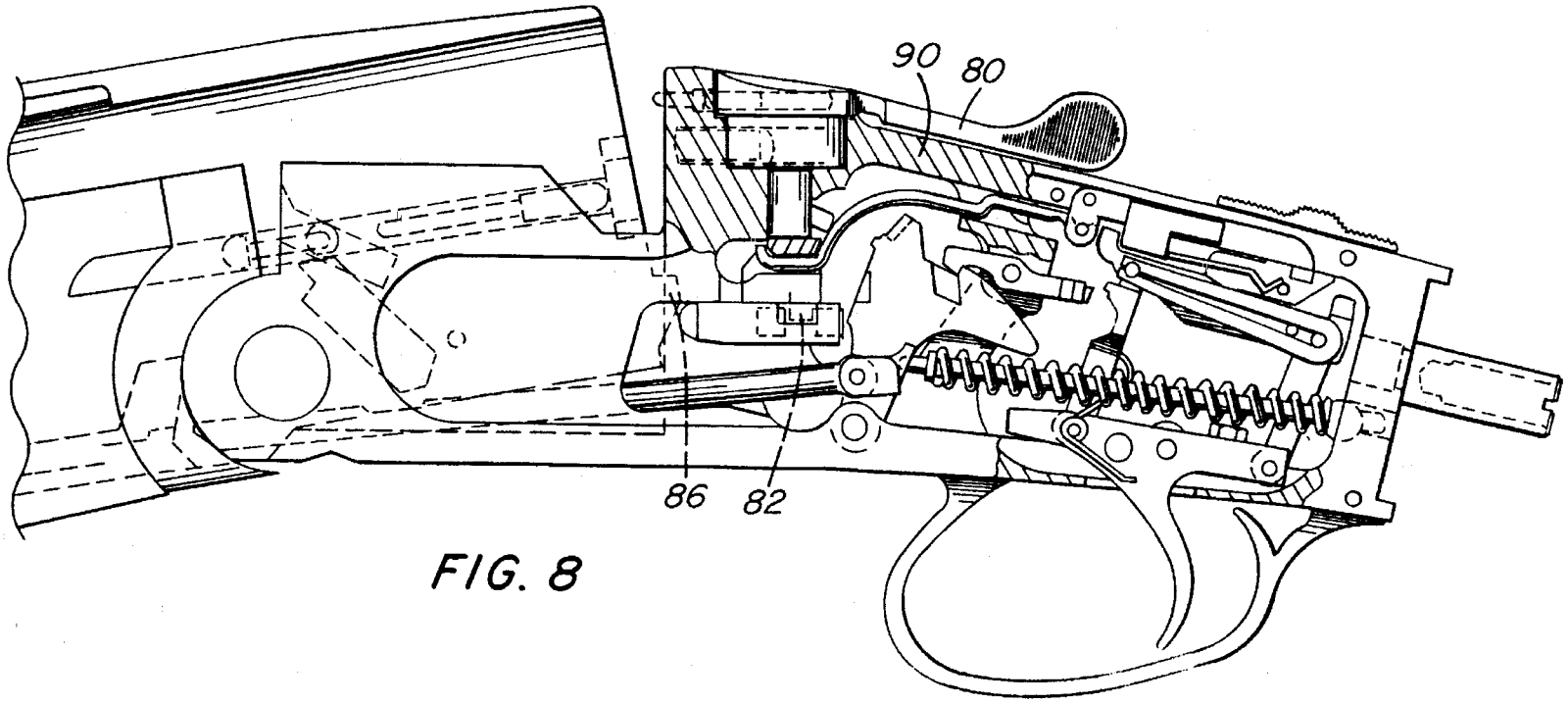
FIG. 8 is a left hand side view of the top lever adjusting system in the unlocked position, with the barrel assembly pivoted partially open.

As shown in FIGS. 6 and 8, the top lever 80 is pivotally mounted in the frame 14 and has an off-center cam projection 82 which activates the locking bolt 84 slidably positioned in the frame to engage the barrel assembly locking lug 86 when the top lever 80 is in the closed position. In FIGS. 6 and 7, the top lever is in the central position after camming the locking bolt to its forward position over the barrel locking lugs. By contrast, in FIGS. 8 and 9, the top lever has been rotated to its latched open position after camming the locking bolt to its rearward position to unlock the barrel assembly. As illustrated in those Figures, when the top lever 80 is pivoted to the open position, the cam projection 82 slides the locking bolt 84 rearward disengaging from the locking lug 86 permitting the barrel assembly to pivot open.

Figure 10:
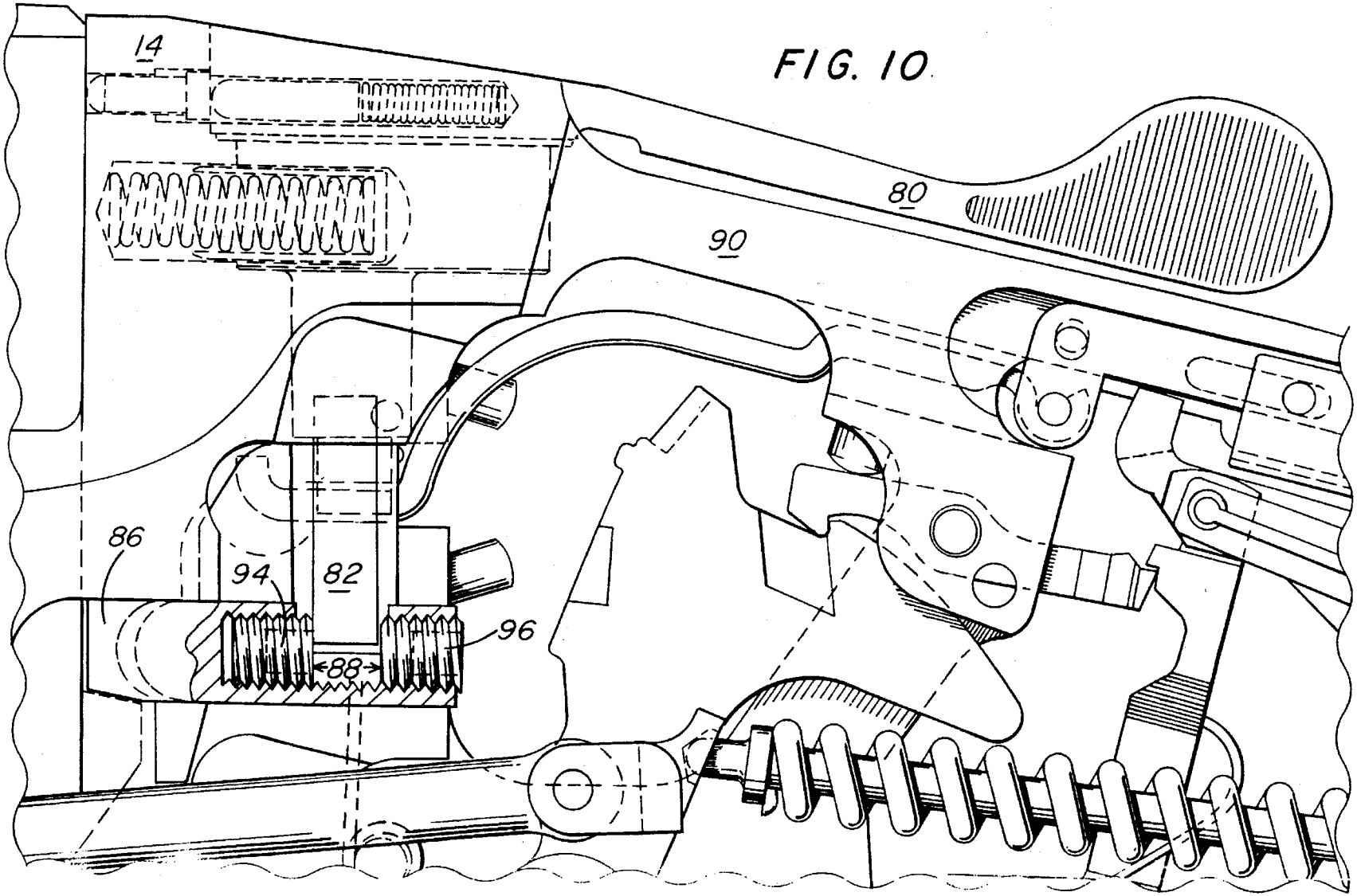
FIG. 10 is an enlarged side view of the top lever adjusting system with the locking bolt in the forward or locked position.
Figure 11:
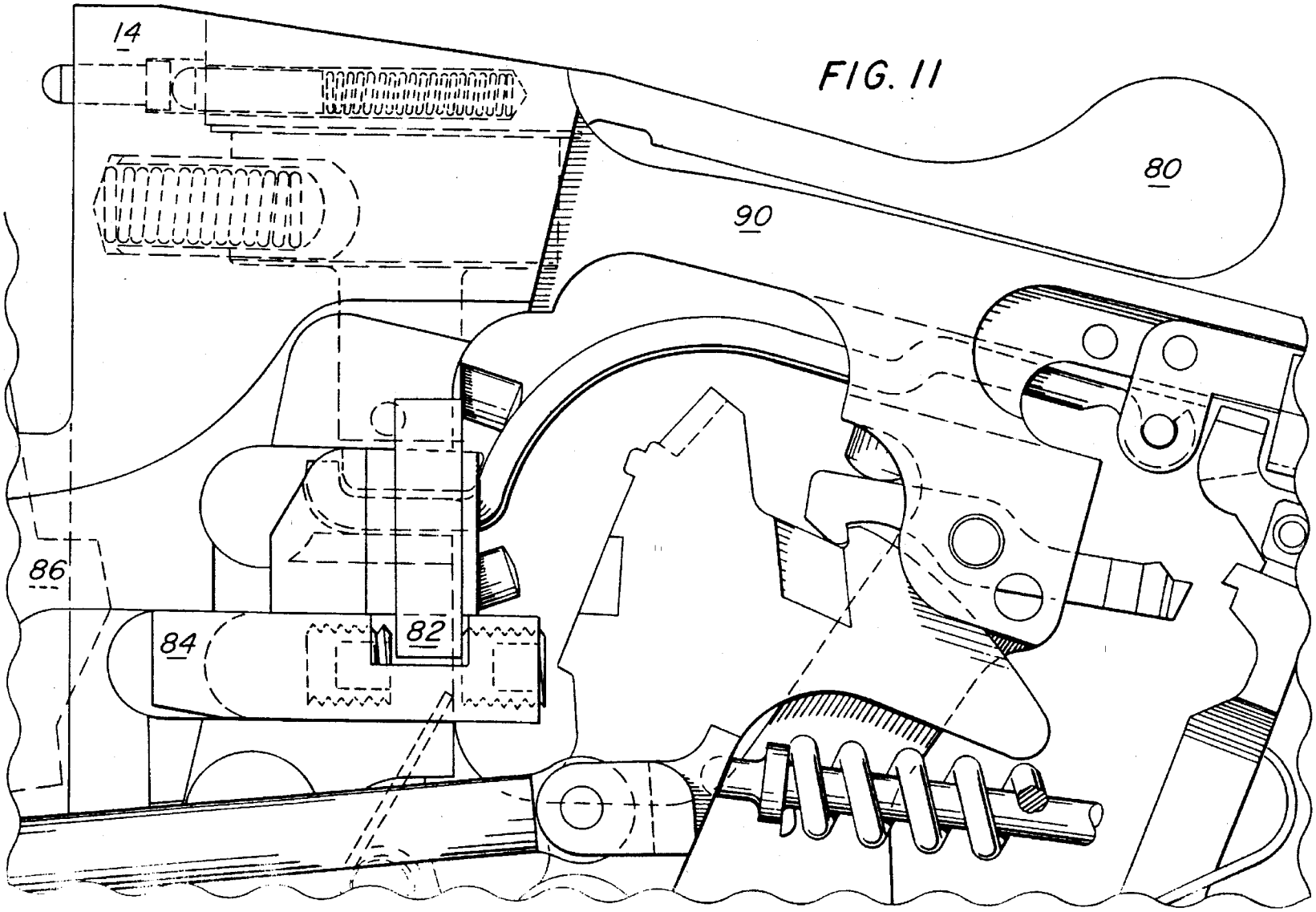
FIG. 11 is an enlarged side view of the top lever adjusting system showing the locking bolt in the rear, or unlocked, position and the top lever in the latched, or open, position.
Figure 12:
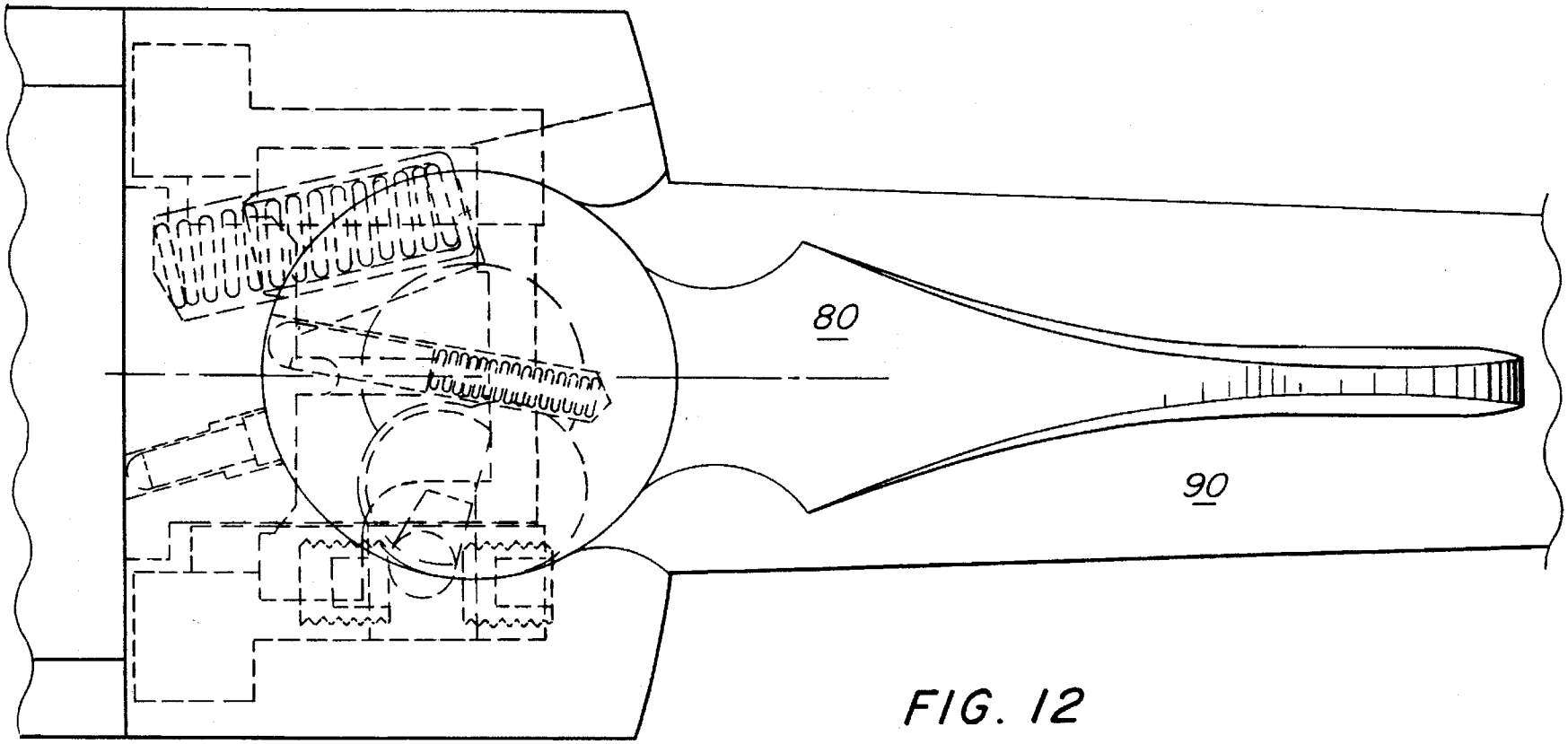
FIG. 12 is an enlarged top view of the top lever adjusting system corresponding to the side view shown in FIG. 10.
Figure 13:
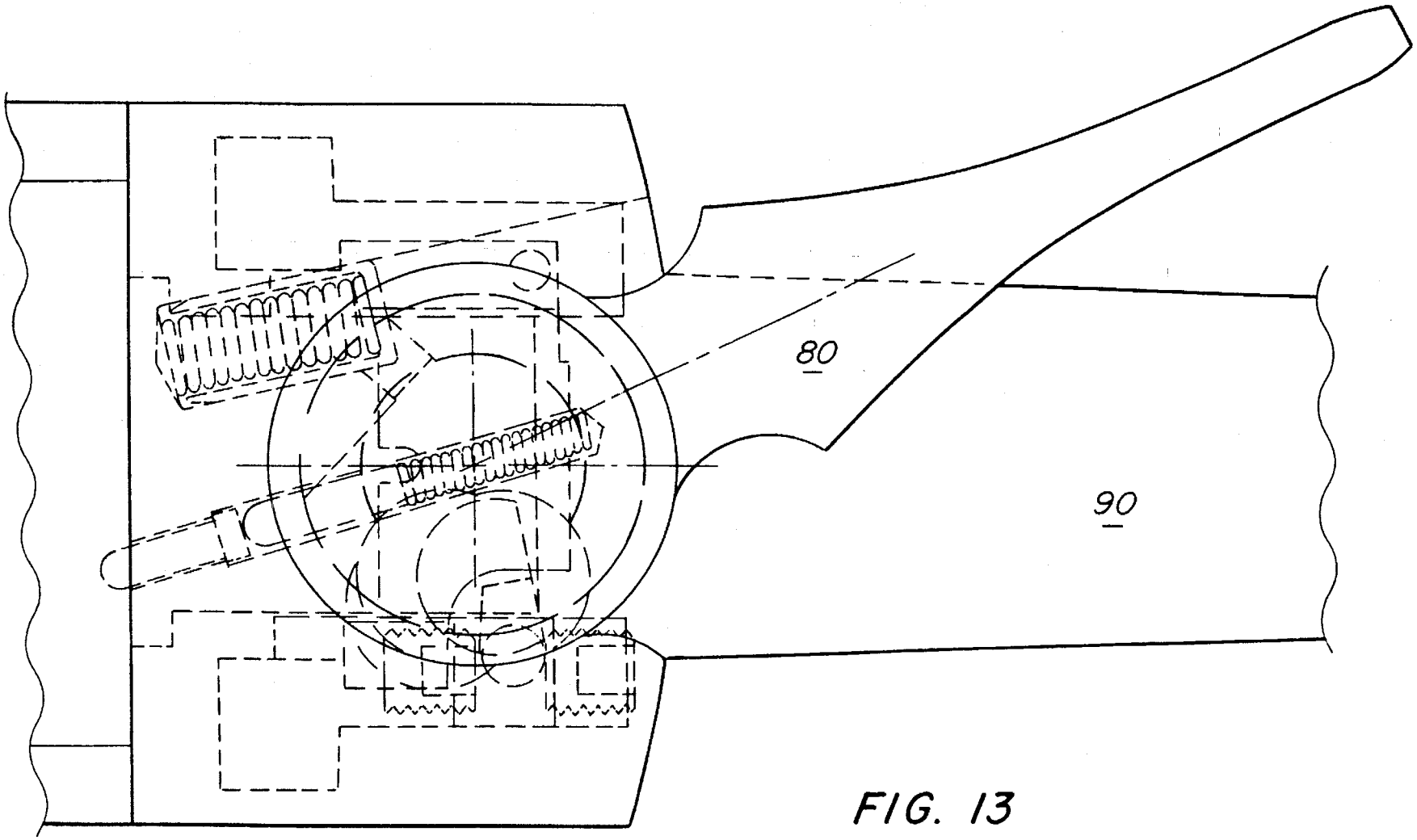
FIG. 13 is an enlarged top view of the top lever adjusting system corredponding to the side view shown in FIG. 11.

The interconnection between the cam projection 82 and the locking bolt conventionally has been merely having the projection 82 extend down into the lug opening 88, as shown on FIG. 10, and by precision hand work locate the projection in the opening to obtain the desired radial alignment of the top lever with the frame. Further, conventionally this projection 82-lug opening 88 relationship was adjusted to a fixed position so the top lever was aligned just to the right of the centerline of the frame top tang 90 when the action is closed. In this fashion as the top lever action wears (projection 82-lug opening 88), the top lever would approach the centerline of the frame. A gun with a top lever left of the centerline is generally considered "worn out," which may not be the case.

To overcome the disadvantages mentioned above, an adjustment mechanism has been provided so that the relationship between the projection 82 and opening 88 can be varied, and thus the alignment of the top lever. Threadably inserted into axial opening 88 are top lever position adjusting screws 94, 96, as shown in FIG. 10, which have hex-recesses accessible from the rear of the bolt 84. The rear screw 96 has to be removed and the top lever raised slightly for access to the front screw 94.

With the adjustment of front screw 94, the radial position of the top lever can be changed and with the adjustment of rear screw 96, the top lever will be latched open at approximately the same time the locking bolt 84 releases from the barrel locking lug 86.

With this adjustable feature, the position of the top lever can be changed as the parts wear and assure good locking bolt and barrel locking lug interaction.

Figure 14:
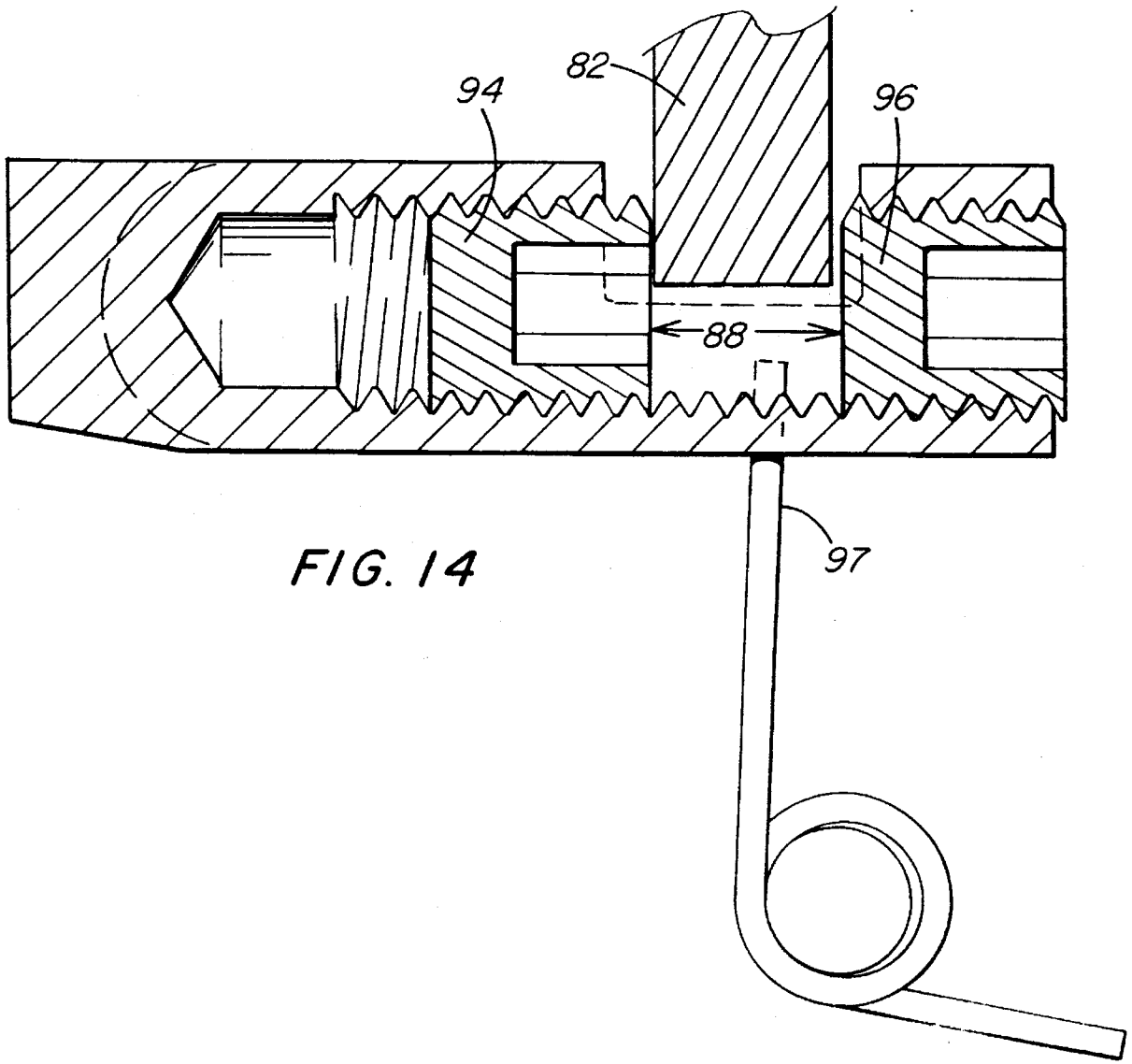
FIG. 14 is an enlarged sectional view of the top lever adjusting system cut through the locking bolt, top lever cam projection and adjusting screws.

FIG. 14 further illustrates locking bolt spring 97, biased between the frame and the locking bolt to insure contact of both sides of the locking bolt lugs with the barrel lugs.

Figure 15:
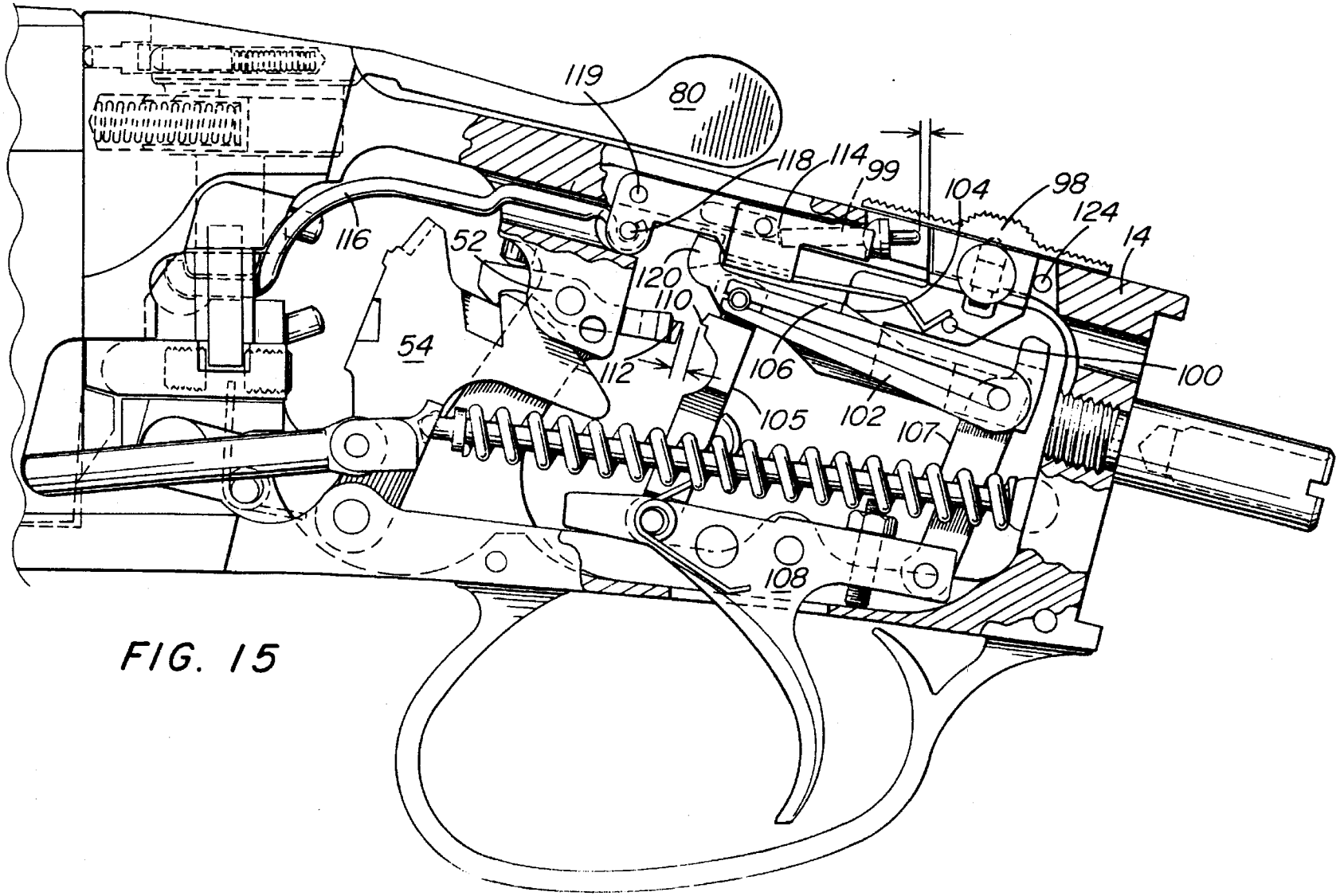
FIG. 15 is an enlarged left hand side view of the safety system with the firing mechanism in the automatic safety mode.

FIG. 15 is an enlarged left hand side view of the preferred safety system with the firing mechanism in the automatic safety mode. Spring-biased safety switch 98 is slidably mounted in a front-to-rear slot, not shown, in frame 14, and retained by safety switch detent pin 100. The safety switch is connected to selector block 102 by means of projection 104 on the safety switch. The projection connects with slot 106 formed in the selector block. The selector block is pivotally connected to front connector arm 105 and rear connector arm 107, which are both pivotally connected to trigger base 108. The front connector arm has tab 110, which engages, in firing condition, step 112 on the hammer sear 52. With the safety on, these are separated by a gap, as shown between these elements in FIG. 15, preventing operation of the firing mechanism.

The mechanism further comprises auto safety actuator 114, which, in its rearward position, abuts the safety switch. In normal operation, the auto safety actuator is attached to the rear end of auto safety actuating rod 116 by means of pin 118. Thus connected, when the auto safety actuating rod is pushed rearward, the auto safety actuator will abut the safety switch at its front end, thus putting the safety in the "on" position. When the pin 118 is removed, the rear end of the auto safety actuating rod will nonetheless abut the front nose 120 of the selector block, thus disengaging the firing mechanism when the gun is open.

Figure 16:
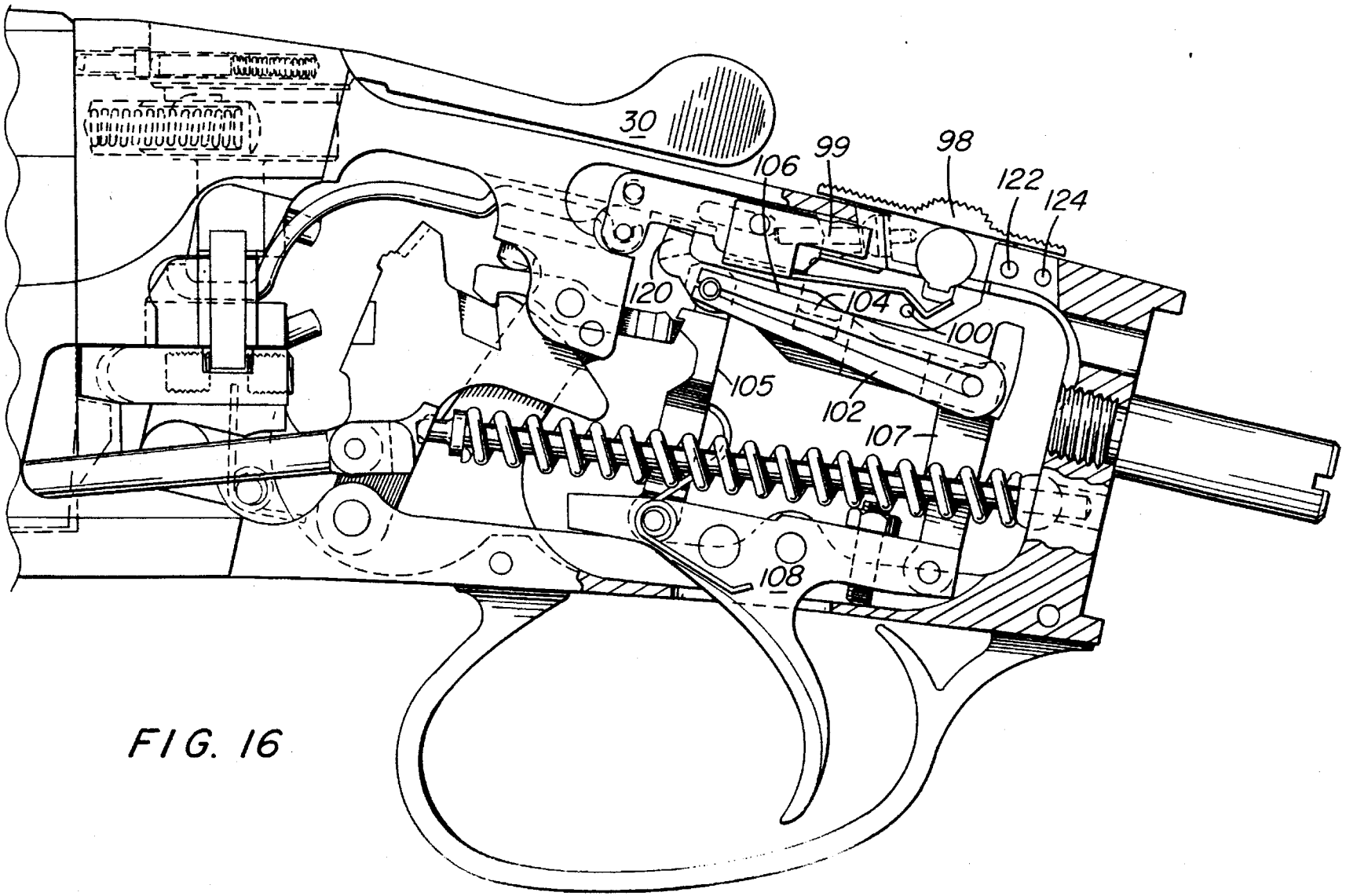
FIG. 16 is the same view as FIG. 15, except that the safety switch has been moved forward to the ready-to-fire position, connecting the trigger mechanism to the sear.

The safety mechanism preferably further comprises means for the permanent selection of the first-firing barrel in a double barrel shotgun. This is illustrated more fully in FIG. 16, showing aperture 122 formed transversely through the frame forward of the aperture for safety switch stop pin 124. The switch is adapted to move from left to right to select, in a double barreled shotgun, the barrel to be fired first. For a permanent selection of that barrel, the pin 124 can be removed from the aperture and inserted in the appropriate side of aperture 122. This provides for a fixed selection of the barrel and, at the same time, disables the safety mechanism by preventing the rearward movement of the safety switch. The safety switch is, in FIG. 16, engaged with the barrel guide pin 99, which engagement is not possible in the position shown in FIG. 15, in which there is a gap between the safety switch and the guide pin.

Figure 17:
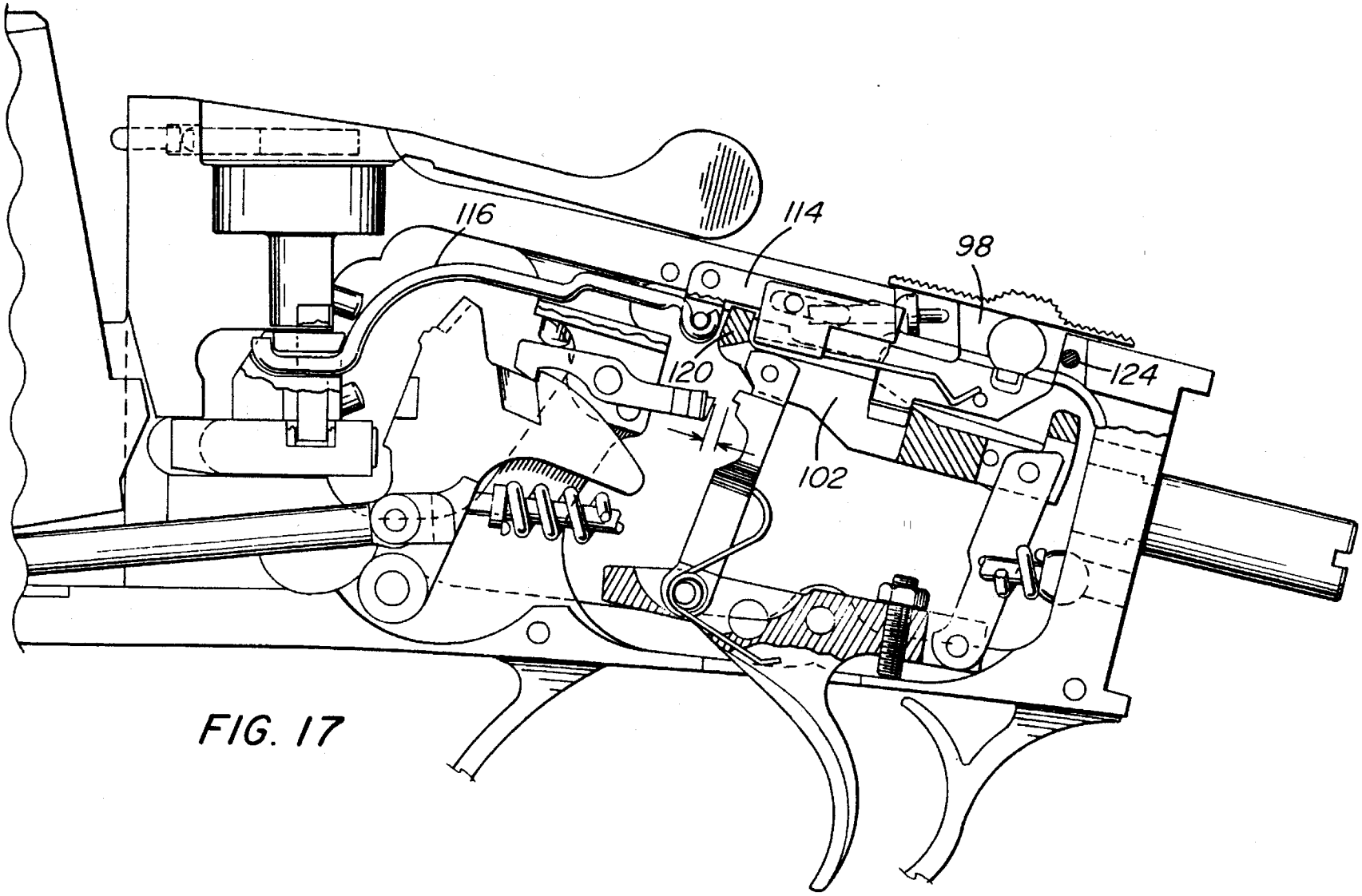
FIG. 17 is an enlarged left hand side view of the safety system, with the firing mechanism in the automatic safety mode, with the gun unlocked and the barrel assembly pivoting open.

FIG. 17 is an enlarged left hand side view of the safety system, with the firing mechanism in the automatic safety mode, with the gun unlocked and the barrel assembly pivoting open. The safety switch has automatically been moved to its rear "safe" position by the auto safety actuator 114, disconnecting the trigger mechanism from the sear 52.

Figure 18:
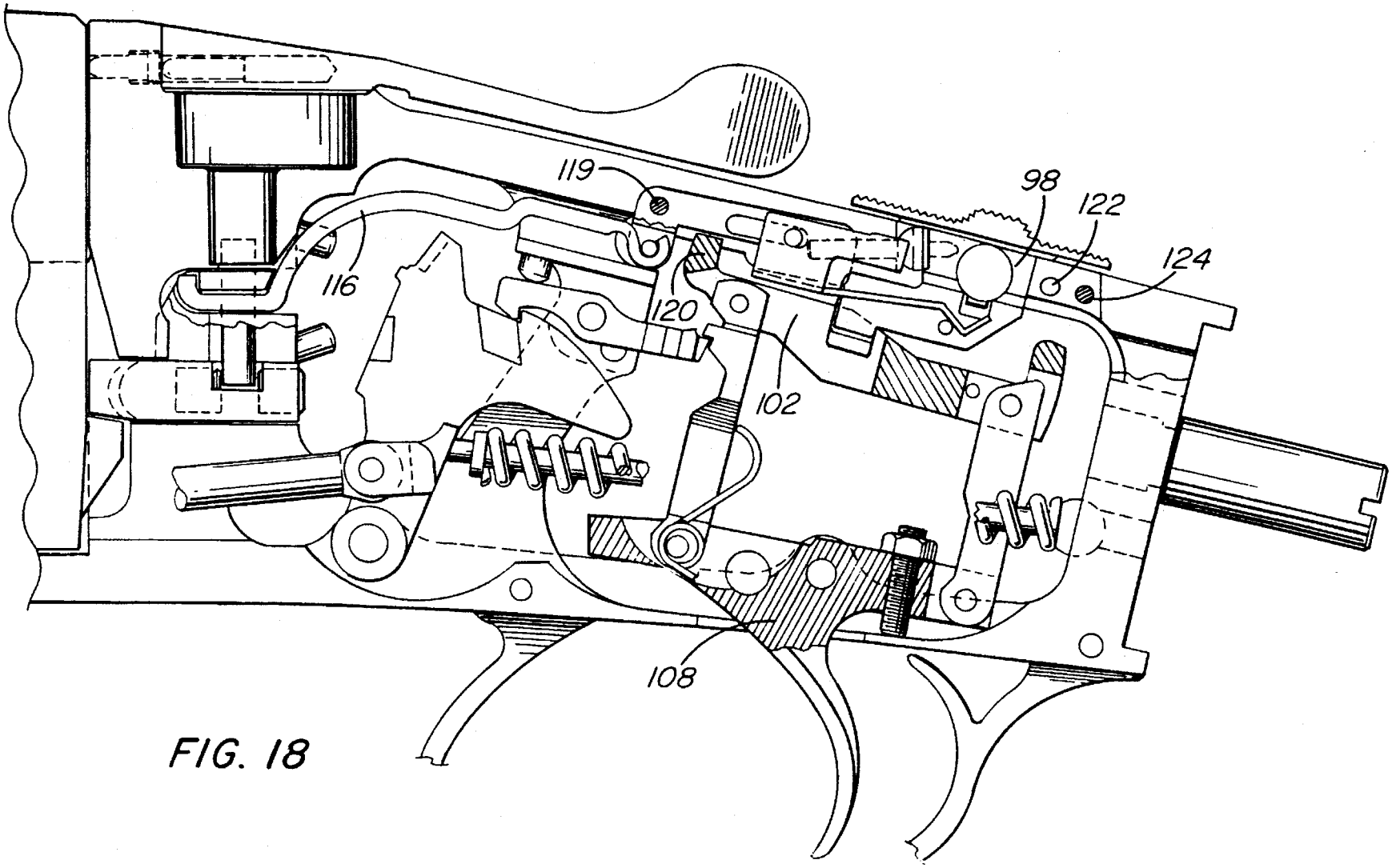
FIG. 18 is an enlarged left hand side view of the safety system, showing the firing mechanism in the manual safety mode, with the barrel assembly lockind in the closed position and the safety switch moved forward to the ready-to-fire position, conecting the trigger mechanism to the sear.

FIG. 18 is an enlarged left hand side view ot the safety system, showing the firing mechanism in the manual safety mode, with the barrel assembly locking in the closed position and the safety switch moved forward to the ready-to-fire position, connecting the trigger mechanism to the sear. The pin for the rear end of the auto safety actuating rod has been moved to aperture 119. The safety switch stop pin 124 is in its normal, rearward position.

Figure 19:
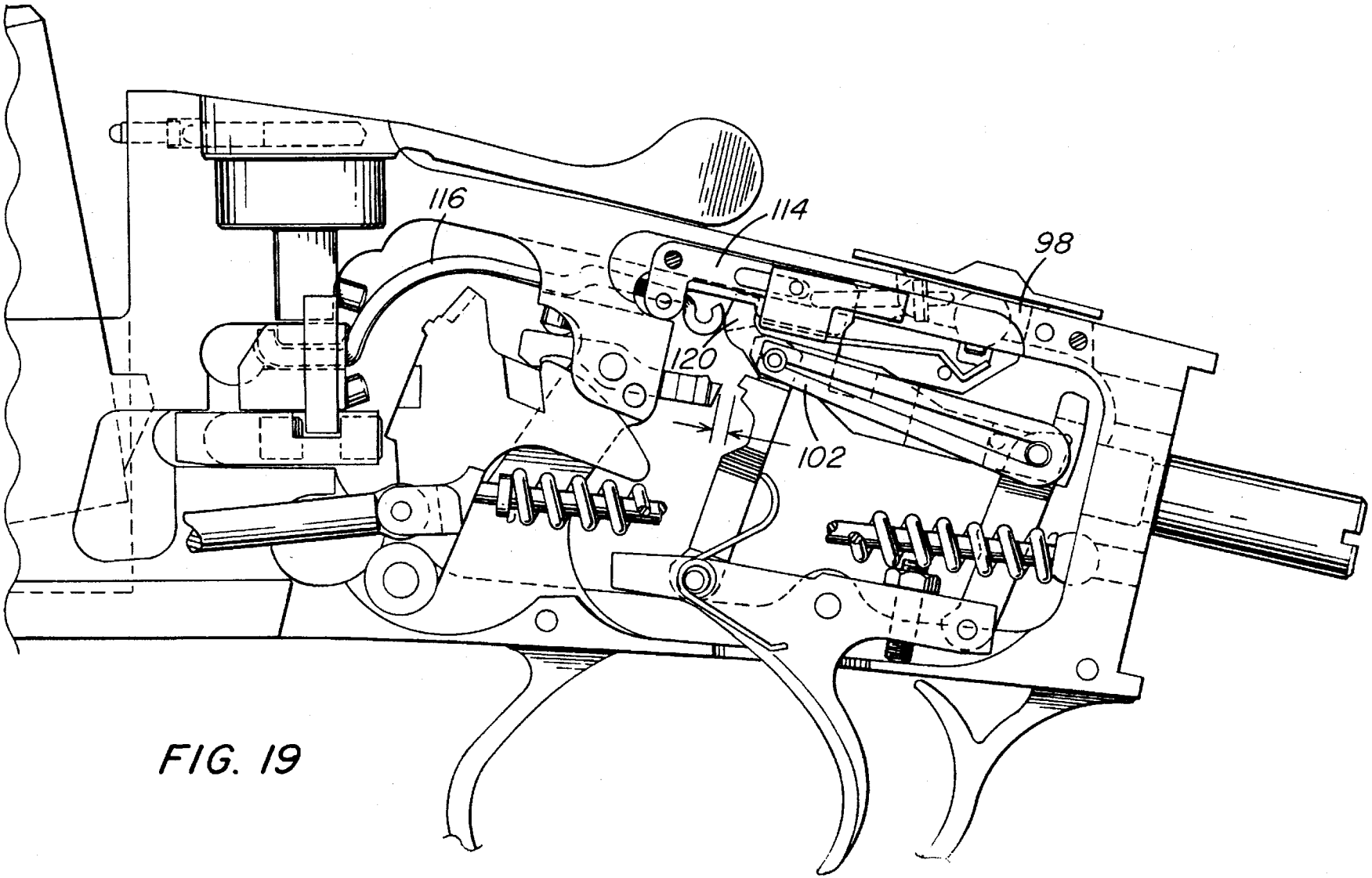
FIG. 19 is an enlarged left hand side view of the safety system, showing the firing mechanism in the manual safety mode, with the gun unlocked and the barrel assembly pivoting open.

FIG. 19 is an enlarged left hand side view of the safety system, showing the firing mechanism in the manual safety mode, with the gun unlocked and the barrel assembly pivoting open. The safety switch is still in the ready-to-fire position, but the trigger mechanism has been disconnected from the sear by the auto safety actuating rod. In this configureation, as soon as the gun is again locked up, it will be ready to be fired.

Figure 20:
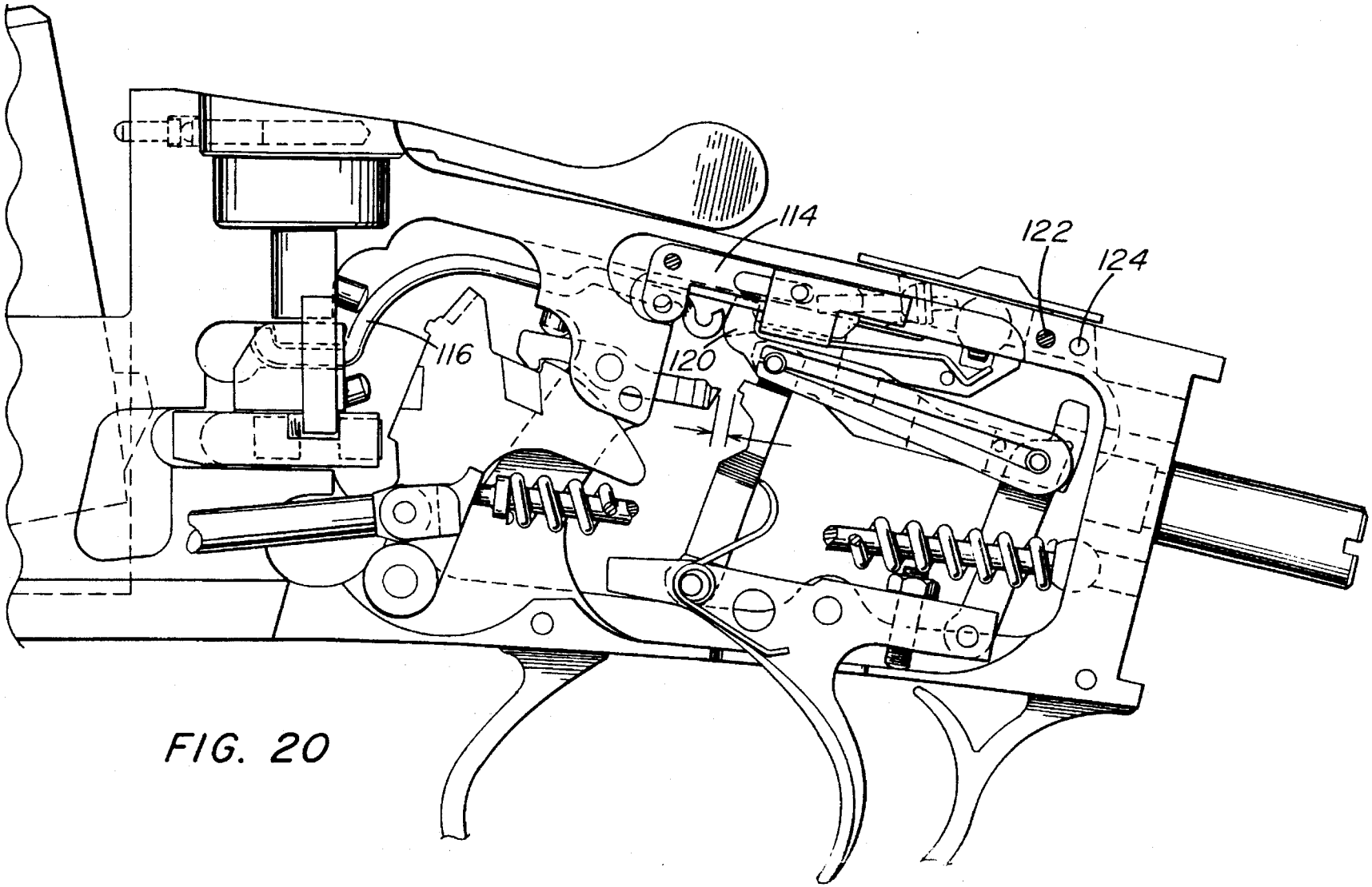
FIG. 20 is the same view as FIG. 19, except that the safety switch has been locked in the ready-to-fire position, to always fire a pre-selected barrel first.

FIG. 20 is the same view as FIG. 19, except that the safety switch has been locked in the ready-to-fire position, to always fire a pre-selected barrel first. There, the trigger mechanism is still disconnected from the sear by the auto safety actuating rod when the gun is unlocked and the barrel assembly is pivoted open.

Figure 21:
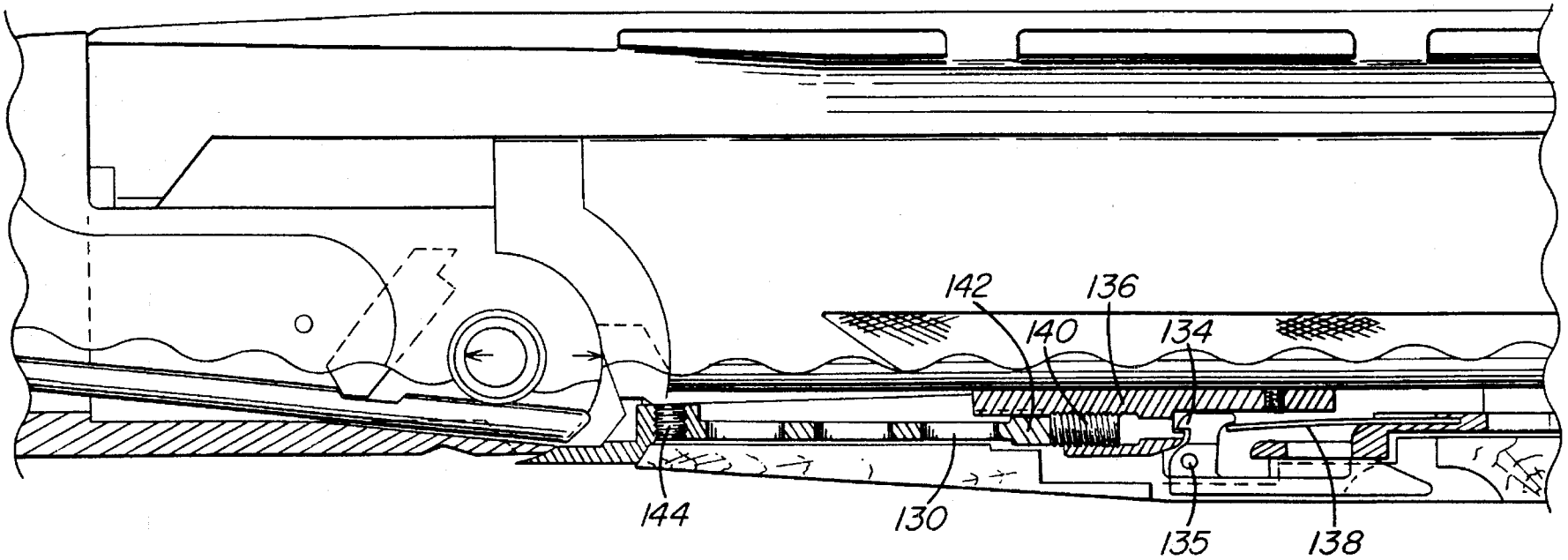
FIG. 21 is a cross-sectional view of the fore-end tension adjusting system.

FIG. 21 is a cross-sectional view of the preferred fore-end tension adjusting system, comprising fore-end iron 130 to which is attached fore-end latch 132, connected to the other portion of the fore-end iron by side rails, not shown. The fore-end latch comprises hook portion 134 pivoted at pivot pin 135. The latch is biased against the mating barrel lugs 136 by leaf spring 138. The barrel lug include adjusting screw 140 biased against the fore-end iron at abutting interface 142. The fore-end iron further comprises fastening means 144, which provides a means for adjusting the clearance between the fore-end iron and the barrel in the initial assembly of the apparatus.

The features of the present invention provide several important advantages in firearms.

The preferred combination automatic ejection and hammer cocking mechanism of this invention contains fewer parts than many previous over and under shotguns. The present system is also readily converted to a manual ejection system. This feature will be very beneficial for those shooters who save their fired shells for reloading.

Further, the top lever adjusting system of the present invention allows the radial positioning of the centerline of the top lever just to the right of the centerline of the frame top tang when the action is closed. Specifically, the top lever adjusting system allows the radial position of the centerline of the top lever to be easily positioned just to the right of the centerline of the frame top tang when the action is closed. Adjustment is also available to ensure that the top lever is in a position to latch itself open before the barrel assembly can be released to pivot the gun open. The top lever adjusting system eliminates the extensive precision hand work that previously was required to initially position the top lever centerline and also control when the barrel assembly is released. Additionally, it allows a well used. gun's top lever, the centerline of which has moved to the left of the top tang centerline, to be readjusted to the right, as it was when it was a new gun.

The automatic safety system of the present invention can be easily converted to a manual safety and the safety/barrel selector mechanism can also be locked in the fire position to always fire a preselected barrel first. A large number of modem over and under shotguns incorporate a safety switch that is automatically returned to the "safe" position each time the top lever is operated to break the gun open for reloading or unloading. This requires that the safety switch be pushed to the fire position before the gun can again be fired. Many competitive target shooters do not like this automatic safety system and will have it converted to a manual safety system, such that as soon as the gun is reloaded it can be fired without having to operate the safety switch. In addition to their preference for a manual safety switch, competitive target shooters also like to lock their barrel selectors so that they always fire a preselected barrel first.

The preferred safety of present invention accomplishes both of these requirements in such a way that none of the modifications are necessarily permanent and the full function of the automatic safety can be easily restored. Prior shotguns that incorporate automatic safeties can have them modified to manual safeties. This procedure is somewhat involved, requiring that parts be permanently removed from the safety mechanism by a competent gunsmith. The present invention makes the modification very easy, by simply repositioning parts that then must remain with the firearm in order for it to function correctly.

The preferred fore-end assembly tension adjesting system of the present invention permits barrel interchangeability with no change in the fore-end assembly tension. The present invention provides an easily accessible tension adjusting screw that is mounted in the barrel lug.

We claim:

1. In a break open firearm having a frame attached to a stock, a barrel housing carrying at least one barrel and rotatable about a pivot on the frame at least one hammer pivotally mounted on the frame for movement from a cocked position to a position against the frame, a hammer spring urging the hammer forwardly, a firing pin aligned with each said hammer, trigger means operatively connected to actuate the hammer, a cocking rod mounted for reciprocation on the frame for acting on the hammer, and cam means for moving the cocking road rearward when the barrel housing is rotated about the frame, a fore-end housing and means for ejecting cartridges from the firearm, the improvement comprising a top lever pivotally mounted on the frame for opening the firearm, the top lever having an off-center cam projection which activates a locking bolt slideably positioned in the frame to engage a barrel assembly locking lug to move a locking bolt between locked and unlocked positions, the cam projection being positioned in an axial opening, and forward and rearward adjusting screws positioned to impinge on at least a portion of the cam projection to adjust the cam projection within the axial opening and the position of the top lever.

2. A firearm of claim 1 having at least two barrels.

3. A firearm of claim 2 wherein the barrels are arranged in an over and under configuration

4. A firearm of claim 1 wherein each said barrel is adapted to receive shot shells.

5. A firearm of claim 1 further comprising an ejector system comprising a cam depression formed in each said cocking rod, an ejector sear slideably disposed in a slot in the barrel housing, the scar having an upper and a lower end said lower end positioned in the cam depression formed in the cocking rod when the cocking rod is in its rearward position, an ejector slideably disposed in a groove formed in the barrel housing and spring biased rearwardly, the upper end of the ejector sear being positioned to latch the groove in the ejector upon rearward movement of the ejector, a frame projection positioned to cam against the ejector sear upon rotation of the barrel housing about the frame to move the ejector sear rearward, releasing the ejector.

6. A firearm, of claim 1 further comprising a safety mechanism for disengaging the trigger means from the hammer, the safety comprising an auto safety actuating rod having a front end and a rear end, the front end operatively connected to a locking bolt mechanism to move rearward when the locking bolt mechanism is opened, an attaching means detachably connecting the auto safety actuating rod to an auto safety actuator which is slideably disposed in the frame in a path parallel to the horizontal axis of the firearm and which in the rearmost portion of the sliding path having a principal axis, abuts a safety switch to put the safety mechanism in the "on" position, the attaching memos between the auto safety actuating rod and the auto safety actuator being below the principal axis of the sliding path of the auto safety actuator, the rear end of the auto safety actuating rod being aligned to impinge, when unattached to the auto safety actuator, upon a front nose portion of a selector block in the trigger mechanism, disengaging the trigger means from the hammer, and, when the auto safety actuating rod is attached to the auto safety actuator, the auto satiety actuator, in its rearmost position, moves the safety switch to the "on" position.

7. An apparatus of claim 6 wherein the connection means between auto safety actuating rod and the auto safety actuator is a pin removeable to an aperture in the frame.

8. An apparatus of claim 7 wherein the firearm has at least two barrels, the safety switch is adapted for side to side movement to select the barrel to be fired first, the switch moving in a path having a guide pin in the path which restricts side to side motion of the switch in its forward position, and the frame is provided with two side to side apertures rearward of the safety switch and in its sliding path, the rearmost aperture intersecting the sliding path of the safety switch, and the frontmost aperture being adapted to receive a locking pin which, by insertion in one side of the aperture in the frame, inhibits motion of the selector switch, so as to fix the selection of the barrel to be fired first and disable the safety switch.

* * * * *